United States Patent [19]

Wall

[11] Patent Number: 4,870,889

[45] Date of Patent: Oct. 3, 1989

[54] HYDRAULIC DEVICE FOR FUEL PUMPING APPARATUS

[75] Inventor: Robin C. Wall, Rochester, England

[73] Assignee: Lucas Industries Public Limited Company, Birmingham, England

[21] Appl. No.: 177,109

[22] Filed: Apr. 4, 1988

[30] Foreign Application Priority Data

Apr. 11, 1987 [GB] United Kingdom ..... 8708745

[51] Int. Cl.[4] ..... F15B 15/22

[52] U.S. Cl. ..... 91/49; 91/401; 91/419; 91/422; 92/13.6; 92/130 D; 123/387; 137/503; 137/508

[58] Field of Search ..... 91/393, 399, 400, 401, 91/404, 405, 23, 408, 409, 419, 422, 222, 49; 251/285; 137/503, 508, 509; 92/13.6, 130 D; 123/385, 386, 387, 390

[56] References Cited

U.S. PATENT DOCUMENTS

| | | | |
|---|---|---|---|
| 2,875,732 | 3/1959 | Hoffman | 91/422 |
| 3,450,005 | 6/1969 | Ellis | 91/431 X |
| 3,974,853 | 8/1976 | Bentley | 137/503 |

FOREIGN PATENT DOCUMENTS

| | | | |
|---|---|---|---|
| 882740 | 6/1943 | France | 137/503 |
| 998960 | 2/1949 | France | 123/387 |
| 1158728 | 6/1958 | France | 91/401 |
| 423356 | 1/1935 | United Kingdom | 123/386 |

*Primary Examiner*—Robert E. Garrett
*Assistant Examiner*—Mark A. Williamson
*Attorney, Agent, or Firm*—Balogh, Osann, Kramer, Dvorak, Genova & Traub

[57] ABSTRACT

A hydraulic device includes a piston slidable within a cylinder. Fluid under pressure is admitted to one end of the cylinder through an inlet which contains a restrictor. The piston is formed with an orifice and is biased by a first spring towards the one end of the cylinder. A thrust rod is engageable by the piston to transmit the movement of the piston to an external mechanism. When the piston is moved by rising fluid pressure the orifice is closed by the end of the thrust rod so that a higher value of fluid pressure is required to effect the initial movement of the piston than is required to allow the return movement of the piston.

7 Claims, 2 Drawing Sheets

HYDRAULIC DEVICE FOR FUEL PUMPING APPARATUS

This invention relates to a hydraulic device of the kind comprising an actuating piston slidable within a cylinder under the action of fluid under pressure supplied to one end of the cylinder, spring means for opposing the movement of the piston by the fluid under pressure and a thrust rod for coupling the piston to mechanism to be operated by the piston.

An application for such a device occurs in fuel pumping apparatus for supplying fuel to internal combustion engines. The apparatus incorporates a low pressure pump which is driven by the associated engine and the output pressure of the pump is controlled so that it varies in accordance with the speed of the associated engine. It is required that with increasing pump output pressure the mechanism should move in one direction when a predetermined pressure is attained but should not revert until the output pressure has fallen to a value below said predetermined pressure. It is known to provide a valve which controls the supply of fluid to the cylinder in order to achieve the result set out above. However, the provision of the separate valve is expensive and also occupies space in the apparatus.

The object of the present invention is to provide a hydraulic device of the kind specified in a simple and convenient form.

According to the invention in a device of the kind specified the piston defines an orifice through which fluid can flow from said one end of the cylinder, said thrust rod after a predetermined movement of the piston being engaged by said piston, the engagement of the piston by the thrust rod acting to close said orifice and acting to increase the pressure difference between the ends of the piston.

Figure 1:
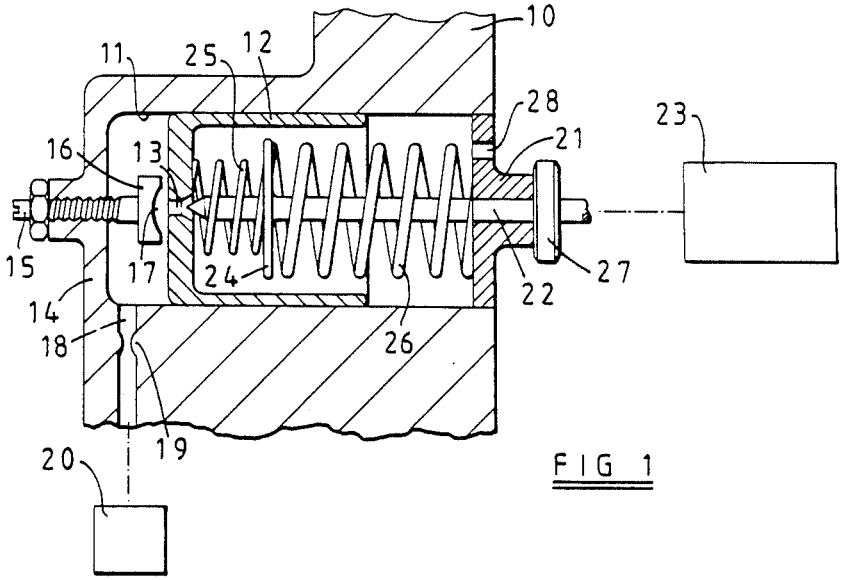
Figure 2:
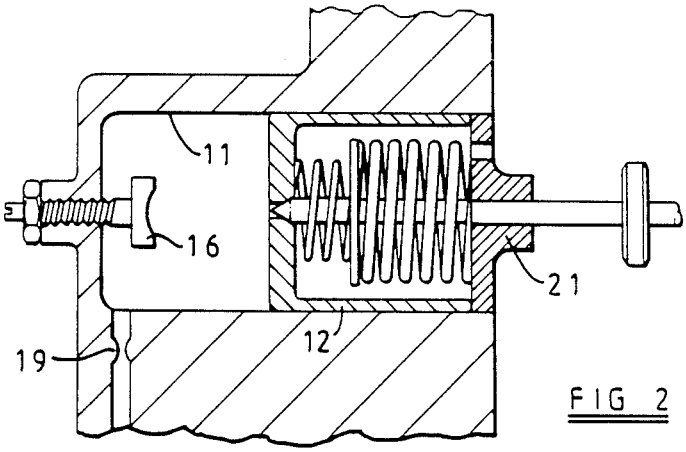
Figure 3:
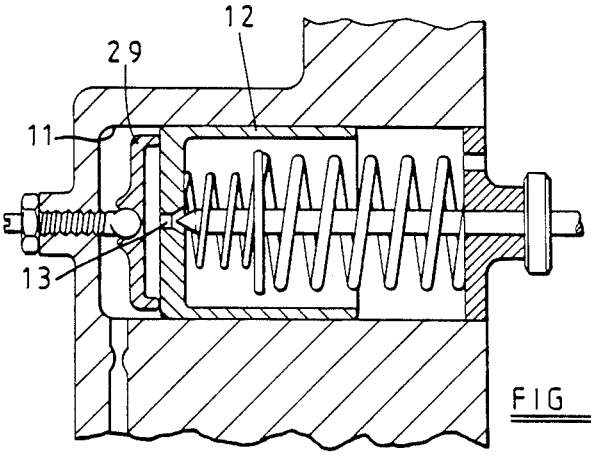
Figure 4:
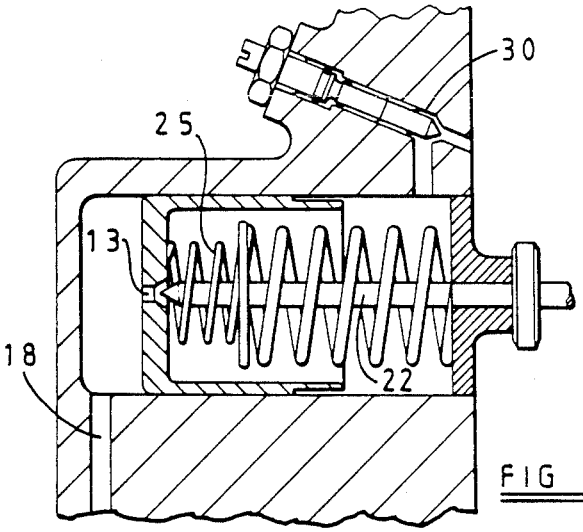

In the accompanying drawings:

FIG. 1 is a sectional side elevation of one example of a device in accordance with the invention, FIG. 2 shows the device of FIG. 1 in a different state, and FIGS. 3 and 4 are views similar to FIG. 1 showing alternative forms of the device.

Referring to FIGS. 1 and 2 of the accompanying drawings the device includes a housing 10 which may form part of the fuel pumping apparatus of an internal combustion engine. Within the housing there is defined a cylinder 11 in which is slidable a cup-shaped piston 12 in the base wall of which is formed an orifice 13. One end of the cylinder is closed by an end closure 14 in which is mounted an adjustable stop 15 which at its end within the cylinder, mounts an abutment member 16 for engagement by the base wall of the piston. The abutment member is provided with a transverse groove 17 so that when the piston is in engagement with the abutment member, the orifice 13 is open to the adjacent end of the cylinder.

Communicating with this end of the cylinder is an inlet 18 which incorporates a fixed restrictor 19, the inlet communicating with a low pressure pump 20 which forms part of the fuel pumping apparatus. The output pressure of the pump 20 varies in accordance with the speed at which the engine with which the apparatus is associated, is driven this being achieved by means of a resiliently loaded relief valve not shown.

The opposite end of the cylinder is closed by an end closure 21 in which is slidably mounted a thrust rod 22.

The thrust rod is connected to a mechanism diagrammatically illustrated at 23 which is to be actuated by the piston and mounted on the portion of the thrust rod within the cylinder is a spring abutment plate 24. A first spring 25 is located between the abutment plate and the base wall of the piston and a second spring 26 is located between the abutment plate and the end closure 21. The extent of movement of the thrust rod 22 by the spring 26 is limited by a collar 27 on the thrust rod which can engage the end closure. Moreover, the end closure is provided with an opening 28.

In the rest position as shown in FIG. 1, the restrictor 19 and the orifice 13 form a fluid potentiometer with the result that initially the pressure in the end of the cylinder to which the inlet is connected, will be lower than the output pressure provided by the pump 20. As the output pressure of the pump 20 increases, the pressure attained in the cylinder will eventually cause movement of the piston against the action of the spring 25 until the end of the push rod which is suitably shaped, obturates the orifice 13. When the flow of fuel through the orifice 13 is prevented, the pressure in the portion of the cylinder connected to the inlet increases to the output pressure of the pump with the result that the piston moves against the action of the spring 26 and in so doing moves the thrust rod 22 and the mechanism 23. The final position adopted by the piston is seen in FIG. 2 in which the end of the skirt portion of the piston engages the end closure 21. As the output pressure delivered by the pump 20 decreases, the piston will remain in the position shown in FIG. 2 until the output pressure of the pump has fallen to a value which is less than the pressure in the cylinder required to effect the initial movement of the piston.

With the arrangement shown in FIG. 1 there will be a flow of fuel through the device from the pump as soon as an outlet pressure is developed by the pump and this results in less fuel being available for other uses within the apparatus. Moreover, the output pressure of the pump is reduced. In order to overcome this problem and as shown in FIG. 3, the end portion of the piston within the cylinder can be covered by a shield 29 which is adjustably mounted. The practical effect of the shield is that a substantial portion of the end face of the piston is protected when the piston is in contact with the shield, from the pressure within the cylinder 11. Moreover, flow of fuel through the orifice 13 is prevented until a small initial movement of the piston takes place. When the piston has moved, the operation of the device is exactly the same as described with reference to FIG. 1.

In the arrangement shown in FIG. 4 the restrictor 19 is omitted and the orifice 13 together with the end of the thrust rod 22 form a restrictor through which fuel can flow between the ends of the cylinder. The escape of fuel from the end of the cylinder which contains the springs takes place by way of an adjustable restrictor 30. In operation, although the end of the piston is exposed to the full output pressure of the pump 20, the end face of the piston within the portion of the chamber which contains the springs, is exposed to a lower pressure which is above drain pressure. This pressure is determined by the fluid potentiometer action of the orifice 13 and the restrictor 30. As the output pressure of the pump 20 increases, a point will be reached at which the force exerted by the spring 25 will be overcome so that the piston will move to close the orifice 13 and thereafter the piston will move the thrust rod 22 as described with reference to the examples of the earlier figures.

I claim:

1. A hydraulic device comprising an actuating piston slidable in a cylinder under the action of fluid under pressure supplied to one end of the cylinder, spring means for opposing the movement of the piston by the fluid under pressure, a thrust rod for coupling the piston to a mechanism to be operated by the piston, an abutment plate mounted on the thrust rod, said spring means including a first spring acting between the abutment plate and the piston and a second spring acting between the abutment plate and an end closure at the other end of the cylinder, and means for limiting the movement of the thrust rod under the action of the second spring, characterized in that the piston defines an orifice through which fluid can flow from said one end of the cylinder, said thrust rod after a predetermined movement of the piston being engaged by said piston to close said orifice and acting to increase the pressure difference between the ends of the piston.

2. A hydraulic device according to claim 1 wherein said means for limiting the movement of the thrust rod under the action of the second spring is carried by the thrust rod.

3. A hydraulic device according to claim 2 characterized in that said thrust rod is guided for movement in said end closure.

4. A hydraulic device according to claim 2 including an inlet through which fluid can enter said one end of the cylinder characterized by a restrictor in said inlet, said restrictor and said orifice forming a fluid potentiometer.

5. A hydraulic device according to claim 4 characterized by an adjustable stop which limits the movement of the piston under the action of the first spring, said stop being adjustable to determine in conjunction with the adjacent end of the thrust rod, the degree of restriction offered by said orifice.

6. A hydraulic device according to claim 5 characterized in that said stop mounts a shield operable when engaged by the piston, to shield part of the end surface of the piston which is exposed to the pressure in said one end of the cylinder.

7. A hydraulic device according to claim 2 including a fluid inlet to said one end of the cylinder characterised by a restrictor in an outlet from the other end of the cylinder.

* * * * *